US005334067A

United States Patent [19]

Henry et al.

[11] Patent Number: 5,334,067

[45] Date of Patent: Aug. 2, 1994

[54] INFLATABLE FLOAT RING WITH REDUNDANT FLOTATION MEANS

[76] Inventors: David M. Henry, P.O. Box 10892; Ronald Marshall, 3219 Point White Dr., NE., both of Bainbridge Island, Wash. 98110

[21] Appl. No.: 33,824

[22] Filed: Mar. 19, 1993

[51] Int. Cl.[5] ..... B63C 9/08

[52] U.S. Cl. ..... 441/131

[58] Field of Search ..... 441/40, 88, 81, 106, 441/108, 126, 129–131, 135

[56] References Cited

U.S. PATENT DOCUMENTS

| | | | |
|---|---|---|---|
| 3,500,485 | 3/1970 | Hillary . | |
| 4,360,351 | 11/1982 | Travinski | 441/94 |
| 4,379,705 | 4/1983 | Saotome | 441/94 |
| 4,613,311 | 9/1986 | Wood | 441/131 |
| 5,022,879 | 6/1991 | DiForte | 441/113 |

FOREIGN PATENT DOCUMENTS

| | | | |
|---|---|---|---|
| 1488672 | 10/1977 | United Kingdom | 441/81 |
| 2108435 | 5/1983 | United Kingdom | 441/130 |

*Primary Examiner*—Jesus D. Sotelo

*Attorney, Agent, or Firm*—Bruce A. Kaser

[57] ABSTRACT

The invention disclosed here is an improvement to a fisherman's float ring whose flotation is normally provided by a donut-shaped inflatable rubber tube. The invention provides the float ring with redundant flotation. This is accomplished by placing a normally deflated secondary tube underneath a seat-supporting fabric which covers the tube. A pressurized gas bottle provides inflating gas for the secondary tube in the event the primary tube is accidentally punctured or deflates. In such case, the secondary tube prevents the float ring from losing its buoyant capability.

5 Claims, 4 Drawing Sheets

INFLATABLE FLOAT RING WITH REDUNDANT FLOTATION MEANS

TECHNICAL FIELD

The invention disclosed here generally relates to inflatable flotation devices. More particularly, the invention relates to float rings and similar kinds of flotation devices which are used by fishermen for recreational fishing and related uses.

BACKGROUND INFORMATION

Most recreational fishermen are familiar with float rings. These devices provide a mobile, floating platform for fly or lure casting. Their general makeup includes a donut-shaped ring in the form of a conventional rubber "inner tube" that is normally used to inflate large tires. A seat made of durable fabric extends across and fills the center opening of the tube. The seat is attached to the tube by either sewing it to or making it homogeneous with a fabric shell that is draped over and around most of the tube's circumference.

Openings through the seat enable the fisherman's legs to extend down into the water below the float ring when it is used on the surface of a lake or other body of water. Most fishermen attach fins to their feet in order to make it easier to propel the ring in one direction or another. Most fishermen also wear chest-high neoprene waders while sitting in the ring in order to keep the lower half of their bodies warm and dry.

The conventional float ring as described above has proven to be a potential trap for the unwary. After a prolonged period of use, the seams of the inner tube tend to weaken and are prone to suddenly splitting apart. Sometimes fishermen use float rings in areas Where there are underwater branches or hidden snags that may Suddenly puncture the tube. In either situation, rapid loss of air and deflation results, possibly endangering the fisherman if he is in deep water and far from shore.

When a float ring deflates, the inner tube collapses and may begin to fill with water. The fabric making up the seat and outer shell, which provides no flotation, collapses and becomes tangled around the fisherman along with the tube.

The fisherman may not be in immediate danger so long as air pockets remaining in the tube provide sufficient flotation to initially keep his head above water. Neoprene waders, when worn, will also provide a certain amount of flotation. However, as mentioned above, most fishermen wear fins in conjunction with float rings. These are difficult or impossible to remove when sitting in a collapsing float ring and, unless removed, make it nearly impossible for a fisherman to free himself from the ring.

When a fisherman is in the above situation, he naturally attempts to swim or paddle to shore where he can disentangle himself. What can happen is that his movements result in the loss of air from remaining air pockets in the tube. When the tube loses all of its air, it becomes a weight instead of a buoyant body. If the fisherman has far to swim, becomes tired, or loses his ability to paddle with his feet because of entanglement with seat fabric, the weight of a fully collapsed ring can drag him under the water.

More than one fisherman has been known to drown in the manner described above. Fisherman have also been known to use float rings on rivers and, in some cases, on the ocean. There, collapsing rings are particularly dangerous because strong currents and undertow are present.

The purpose of the present invention is to provide a redundant or backup flotation device which can be added to existing float rings for safety purposes. In the event of accidental deflation, a float ring incorporating the invention will enable the fisherman to immediately create additional flotation that is sufficient to keep him above water until he can reach shore safely.

Although a search of the prior art may reveal many different kinds of float ring designs, the inventors are unaware of any instance where float-ring safety has been addressed.

SUMMARY OF THE INVENTION

The invention is an improvement to flotation rings and similar kinds of flotation devices which makes them safer for fishermen to use. The invention as a whole is best characterized as a combination of individual elements including a primary inflatable chamber that normally serves as the sole means of flotation. Similar to conventional float rings, a fabric shell is draped over and covers the primary cheer. The shell either defines or supports a seating area in float-supporting relationship relative to the primary chamber. In accordance with the invention, a secondary inflatable cheer is positioned immediately adjacent the primary chamber. The secondary chamber is normally deflated except in emergency situations. Preferably, it is sandwiched between the primary chamber and the fabric covering the primary chamber.

A pressurized gas bottle is connected to the secondary chamber. In the event the primary chamber deflates, as a result of a puncture or the like, the fisherman may activate a gas release valve, thereby causing the gas in the bottle to inflate the secondary chamber. In this way, the fisherman maintains his flotation until he reaches shallow water or shore.

An advantage that the invention provides is that it is retrofittable to existing float rings or equivalent devices. It may be sold as an add-on accessory, or, alternatively, it may be sold as a standard or incorporated feature of a new float ring.

The invention as generally described above will become more clearly understood upon consideration of the following detailed description which is to be taken in conjunction with the appended drawings.

BRIEF DESCRIPTION OF THE DRAWINGS

In the drawings, like reference numerals and numbers refer to like parts throughout the various views, and wherein.

BEST MODE FOR CARRYING OUT THE INVENTION

Figure 1:
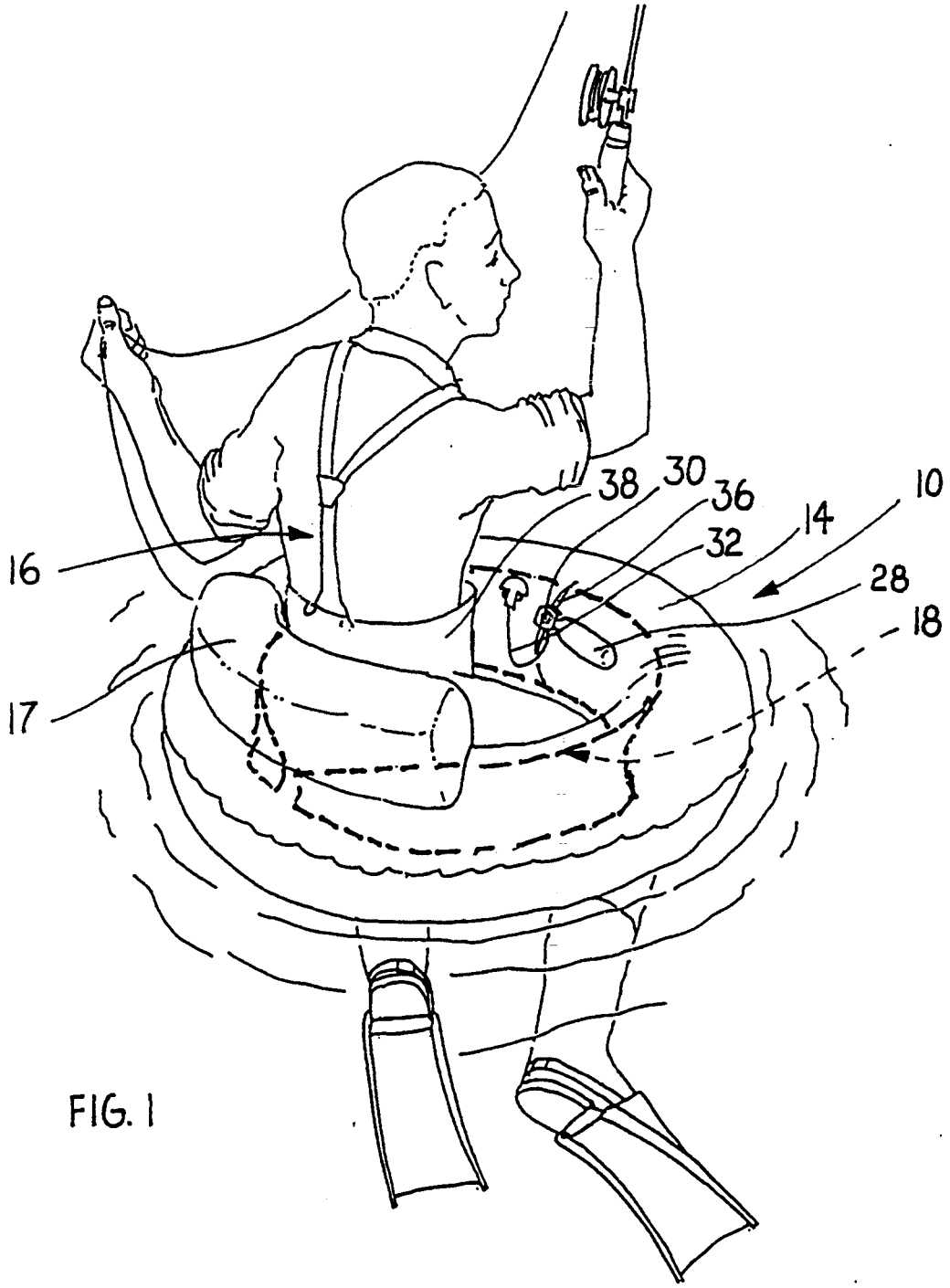
FIG. 1 is a pictorial view of a fisherman wearing waders and sitting in a flotation device, or float ring, that has been improved in accordance with the invention.

Referring now to the drawings, and first to FIG. 1, an improved float ring in accordance with the invention is shown generally at 10. The float ring 10 consists of a donut-shaped primary inflatable chamber 12 (see FIG. 2) which normally provides the sole means for maintaining buoyancy. The primary chamber 12 is generally the same as or similar to a conventional inner tube for a large-size vehicle tire. Preferably, it is completely surrounded and covered by a layer of fabric 14 or fabric shell. The fabric shell 14 provides a means for attaching a seat to the ring 10. The seat, which is not shown, is also made of fabric and is contiguous with the fabric 14 covering the primary chamber 12. The float ring 10 also has an inflatable backrest 17, which is mounted to a rearward area of the ring.

Figure 2:
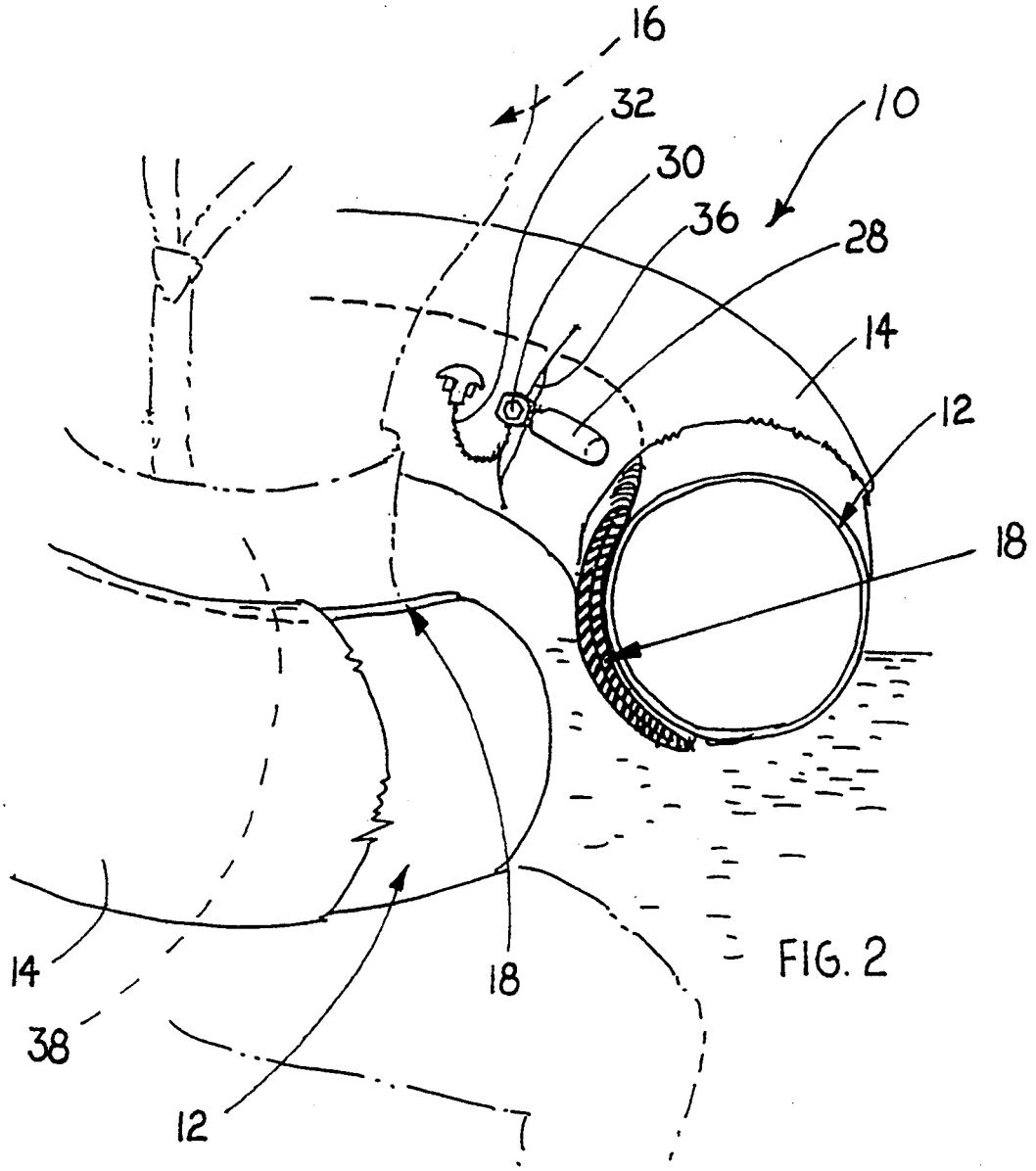
FIG. 2 is an enlarged fragmentary view of the right-hand side of the float ring shown in FIG. 1, with a cross section of the ring's donut-shaped inflatable chamber being cut away in order to show the location of a deflated, secondary inflatable chamber.

As is best seen in FIG. 2, the float ring 10 is modified or improved relative to conventional float rings in that it has a supplemental or secondary inflatable chamber 18. The secondary chamber 18 is sandwiched between the fabric 14 and the primary chamber 12. The secondary chamber 18 is normally deflated so long as the primary chamber 12 maintains its buoyancy.

Figure 6:
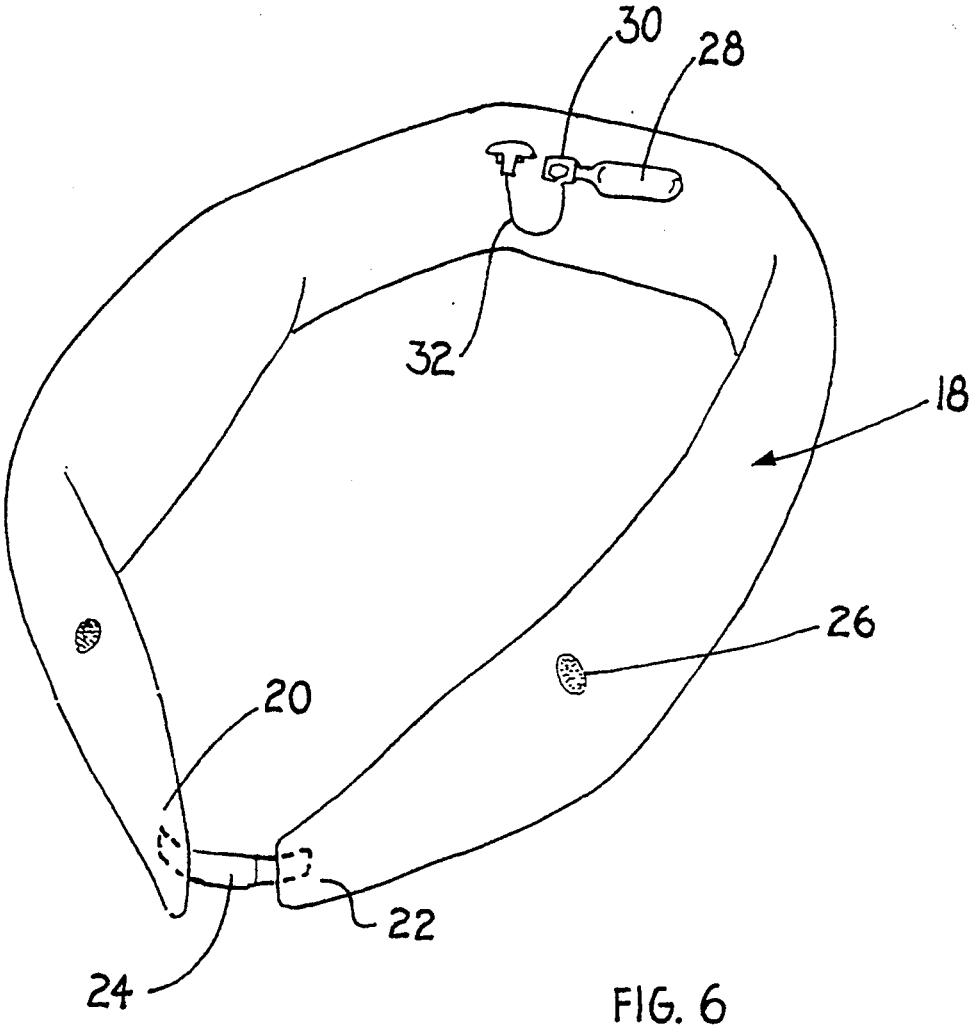
FIG. 6 is a pictorial view of the secondary inflatable chamber detached from the float ring.

In preferred form, the secondary chamber 18 is positioned immediately adjacent and in contact with the inboard side of the primary chamber 12. It also extends around the entire inner circumference of the primary chamber, essentially creating a second "ring." The secondary chamber 18 may be constructed from a single, tubular piece of air-tight material which is connected together at its opposite ends 20, 22 by a cloth strap 24 or the like (see FIG. 6). Further, the secondary chamber 18 may have VELCRO TM fasteners 26 for attaching it to the primary chamber 12. This may not be necessary, however, in that the secondary chamber 18 is in any event held fixed in position against the primary chamber 12 by the fabric shell 14.

A bottle of pressurized gas 28 is connected to the secondary chamber 18 along with a gas release valve 30. The gas release valve 30 is hand-operated by pulling a string 32, which causes the gas in the bottle to inflate the secondary chamber 18. In preferred form, the bottle 28 and/or string 32 are positioned forwardly with respect to the seating area 34 in the middle of the float ring 10. Having such position makes it easy to reach the string 32 in the event the primary chamber 12 suddenly deflates. As is best seen in FIGS. 1 and 2, it may be necessary to provide a slit 36 through the fabric 14 in order to make the bottle 28, valve 30, and string 32 accessible.

Figure 3:
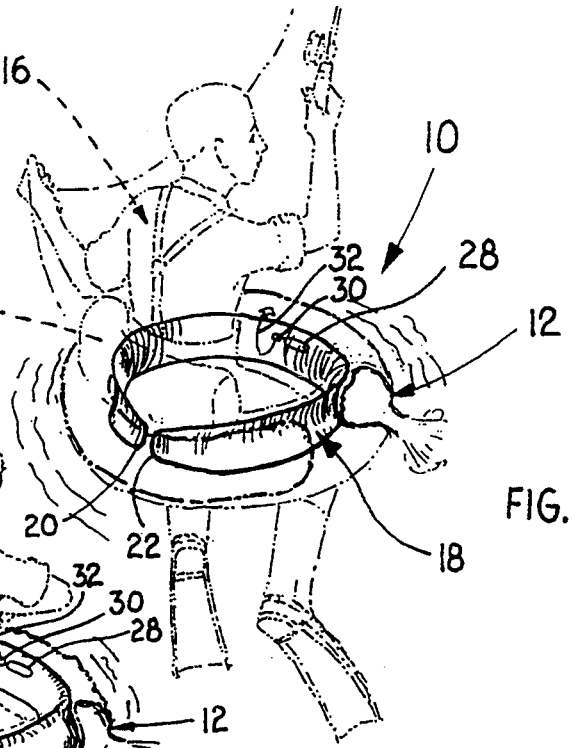
FIG. 3 is the first in a series of three views and illustrates the primary inflatable chamber of the float ring suddenly deflating as a result of a puncture.
Figure 4:
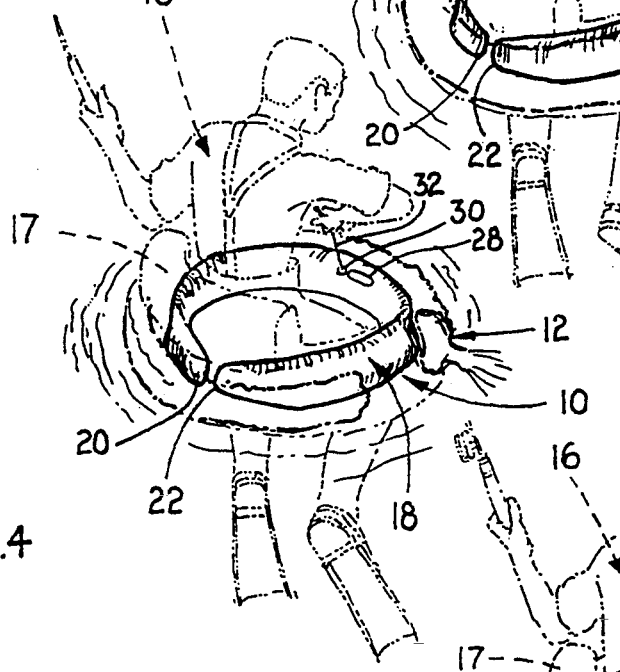
FIG. 4 is the second in a series of three views and shows the fisherman activating a gas release valve in order to inflate the secondary chamber as the primary chamber continues to deflate.
Figure 5:
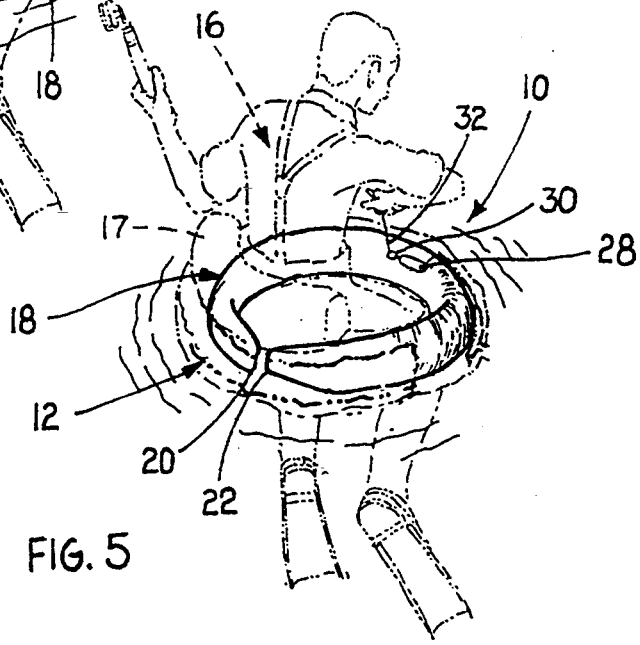
FIG. 5 is the third in a series of three views and shows the secondary chamber fully inflated and providing buoyancy for the fisherman.

Directing attention now to FIG. 3, in the event the primary chamber 12 is accidentally punctured, the flotation ring 10 will, of course, lose its flotation capability. In such case, the user 16 pulls string 32, which causes the secondary chamber 18 to inflate as shown in FIG. 4. Upon full inflation, the secondary chamber 18 maintains buoyancy of the user 16 and ring 10 as shown in FIG. 5. This enables the user 16 to reach shore or shallow water safely.

It is not intended that the preceding description be taken in a limiting sense. It is conceivable that the float ring 10 as described above could be modified in many ways without departing from what is considered to be the spirit and scope of the invention. For example, the float ring 10 shown in the drawings is fully circular and donut-shaped in design. As was mentioned previously, this configuration is fairly conventional. However, it is conceivable that the invention could be used in connection with certain types of flotation devices having a primary chamber in a "U" shape, or in another shape that provides similar flotation capability. Also, it may not be necessary that the secondary or backup chamber 18 have a fully encircling configuration.

Use of the term "surrounding" as set forth in the subjoined claims should be interpreted as including fully encircling, U- or horseshoe-shaped, and equivalent configurations. Furthermore, use of the term "adjacent" in the context of the claims should be taken to mean "next to" but shall include both contact and non-contact situations.

Although the invention as described above is directed to providing a safety mechanism for a fisherman's float ring, it is to be further understood that the invention could have other recreational uses, or perhaps, nonrecreational uses as well. Therefore, the scope of the invention is to be limited solely by the subjoined claims, the interpretation of which is to be made in accordance with well established doctrines of patent claim interpretation.

We claim:

1. An improved flotation device, comprising:

A primary inflatable chamber, the primary chamber being inflated when a user of the device first puts the device into use on a body of water, a user seating area that is surrounded by the primary chamber, at least one secondary inflatable chamber, the secondary chamber normally being deflated when the primary chamber is inflated, the secondary chamber also being positioned adjacent the primary chamber, a fabric covering draped over substantially all of the primary chamber, the secondary chamber being held in position adjacent the primary chamber by sandwiching the secondary chamber between the fabric covering and the primary chamber, and at least one pressurized gas bottle connected to the secondary chamber for inflating it, the bottle having a user-activated gas release mechanism that is within reach of the user when the user is seated in the seating area, whereby the user releases the gas in the bottle and inflates the secondary chamber upon accidental deflation of the primary chamber, in order to maintain buoyancy of the flotation device.

2. The flotation device set forth in claim 1, wherein the primary chamber is donut-shaped and the secondary chamber is positioned immediately adjacent the primary chamber and extends substantially around the inner circumference of the primary chamber.

3. The flotation device set forth in claim 2, wherein the secondary chamber is made of a single tubular piece of an air-tight fabric, the air-tight fabric encircling the seating area of the flotation device and having opposing ends which are connected together by a strap member.

4. The flotation device set forth in claim 1, wherein the primary chamber is donut-shaped and the secondary chamber is positioned immediately adjacent the primary chamber and extends substantially around the inner circumference of the primary chamber.

5. The flotation device set forth in claim 1, wherein the secondary chamber is positioned immediately adjacent the primary chamber and extends substantially along an inboard side of the primary chamber.

* * * * *